US005816630A

United States Patent [19]

Bennett et al.

[11] Patent Number: 5,816,630

[45] Date of Patent: Oct. 6, 1998

[54] LATCH AND LOCK SYSTEM

[75] Inventors: Cameron L. Bennett, Concord; Donald J. McFarland, Strongsville, both of Ohio

[73] Assignee: Cleveland Hardware & Forging Company, Cleveland, Ohio

[21] Appl. No.: 715,964

[22] Filed: Sep. 19, 1996

[51] Int. Cl.[6] ..... E05B 15/02

[52] U.S. Cl. ..... 292/341.17; 292/47; 292/341.18; 292/DIG. 37

[58] Field of Search ..... 292/341.17, DIG. 37, 292/44, 45, 46, 47, DIG. 43, 341.18

[56] References Cited

U.S. PATENT DOCUMENTS

| | | | |
|---|---|---|---|
| 4,007,955 | 2/1977 | Kobayashi | 292/341.17 |
| 4,073,170 | 2/1978 | Miyabayashi et al. | 292/DIG. 37 |
| 4,202,571 | 5/1980 | Nishikoori | 292/DIG. 43 |
| 4,273,368 | 6/1981 | Tanaka | 292/DIG. 43 |
| 4,290,281 | 9/1981 | Knaack et al. . | |
| 4,488,669 | 12/1984 | Waters . | |
| 4,671,548 | 6/1987 | Haberle et al. | 292/DIG. 43 |
| 4,946,208 | 8/1990 | Myslicki et al. | 292/341.18 |
| 5,308,126 | 5/1994 | Weger, Jr. et al. . | |

*Primary Examiner*—Rodney M. Lindsey
*Attorney, Agent, or Firm*—Calfee, Halter & Griswold LLP

[57] ABSTRACT

A latch and lock system employing a rotary trip pawl/latch assembly actuated by impingement of a disconnected push-button trip arm upon a cam attached to the trip pawl mounting pin. Cross rod connection of the cams of laterally opposed latch assemblies provides dual latch and lock points for a single compartment lid operable through either latch assembly. The lack of a permanent mechanical connection between the pushbutton trip arm and the cam of the latch assembly insulates the latch assembly from forceful attack upon the pushbutton.

12 Claims, 5 Drawing Sheets

LATCH AND LOCK SYSTEM

FIELD OF THE INVENTION

The present invention pertains in general to latches and locking systems for covers such as box lids or doors and, in particular, to latches and locks used in connection with boxes which fit within pickup truck beds.

BACKGROUND OF THE INVENTION

Along with the continuing proliferation of pickup trucks the world over, boxes or containers designed to fit securely within the bed of a pickup truck have become increasingly popular. Such boxes are especially useful and even essential to trucks used by tradesmen and contractors having a large amount of tools and equipment which cannot be held in the cab, or otherwise securely held in the bed. The latching and locking mechanisms of pickup truck bed boxes are especially critical for the safekeeping of valuable tools and equipment.

The most common type of pickup truck box is that which traverses the width of the bed, from one side wall to the other, and is typically positioned directly aft of the cab, as shown for example in U.S. Pat. No. 4,488,669. Different lid arrangements have been devised, including symmetrical wing-style lids which open to the sides of the box, and a single lid hinged along the length of the box. For the single lid style, a cross-latching and locking system is desirable to secure the lid at both ends while enabling the lid to be unlatched and/or unlocked from either side of the box. Pushbutton actuated latches with separate or linked locking mechanisms, such as described in U.S. Pat. No. 5,308,126 have been used in this context. One of the disadvantages of such systems is the obstructive presence of the lock/latch assemblies and the connecting cross rod inside the box. Also, direct mechanical connection of the lock cylinder cam with the latching mechanism allows the lock and latch to be forcefully overridden by punching out the lock cylinder from the outside of the box.

SUMMARY OF THE INVENTION

The present invention provides an improved latching and locking mechanism for a pickup truck box which overcomes the aforementioned and other disadvantages of the prior art. In accordance with one aspect of the invention, a latch and lock system for a pickup truck box having a single lid hinged to open along a length of the box includes first and second latch strikers attached to an underside of the box lid, first and second latch assemblies each attached to a corresponding mounting bracket inside the box, each latch assembly including a latch positioned for engagement with a corresponding striker when the box lid is closed, each latch assembly further including a trip pawl in operative contact with the latch, a cam connected to the trip pawl, a cross rod connected at opposite ends to the cams of the first and second latch assemblies, and first and second latch pawl tripping mechanisms mounted in side walls of the box, each tripping mechanism having a trip arm able to be put in operative contact with the corresponding cam upon actuation of the tripping mechanism.

In accordance with another aspect of the invention, a latch assembly for receiving and holding a striker in a latched position includes a latch body having opposed walls, a striker-receiving valley, a latch and trip pawl each pivotally mounted between the opposed walls of the latch body about pins which traverse the latch body, torsional springs about each pin compressed between the latch and the latch body and between the trip pawl and the latch body, and a cam pivotally mounted upon the pin on which the trip pawl is pivotally mounted, the cam being pivotable by and not connected to an opening mechanism whereby pivoting of the cam causes rotation of the trip pawl which allows the latch to pivot to an open position.

And in accordance with another aspect of the invention, a latch and lock system includes a latch assembly for receiving and holding a striker, the latch assembly including a latch body having striker-receiving valley, and a latch and a trip pawl pivotally mounted on pins within the latch body, torsion springs about the pins on which the latch and trip pawl are mounted, the torsion springs compressed between the latch and the latch body, and between the trip pawl and the latch body, a cam attached to the pin on which the trip pawl is mounted, and an opening mechanism for pivoting the cam to pivot the trip pawl to allow the latch to pivot to an open position wherein a striker is free to exit the striker-receiving valley.

Although described with specific reference to use in connection with a pickup truck box, it is to be appreciated that the principles and concepts and structures of the invention are equally applicable to any covered structure such as a lid or door on any type of container wherein it is desired to releasably latch and lock a member in a closed position. These and other aspects of the invention are herein described in particularized detail with reference to the accompanying Figures.

DETAILED DESCRIPTION OF PREFERRED AND ALTERNATE EMBODIMENTS

Figure 1A:
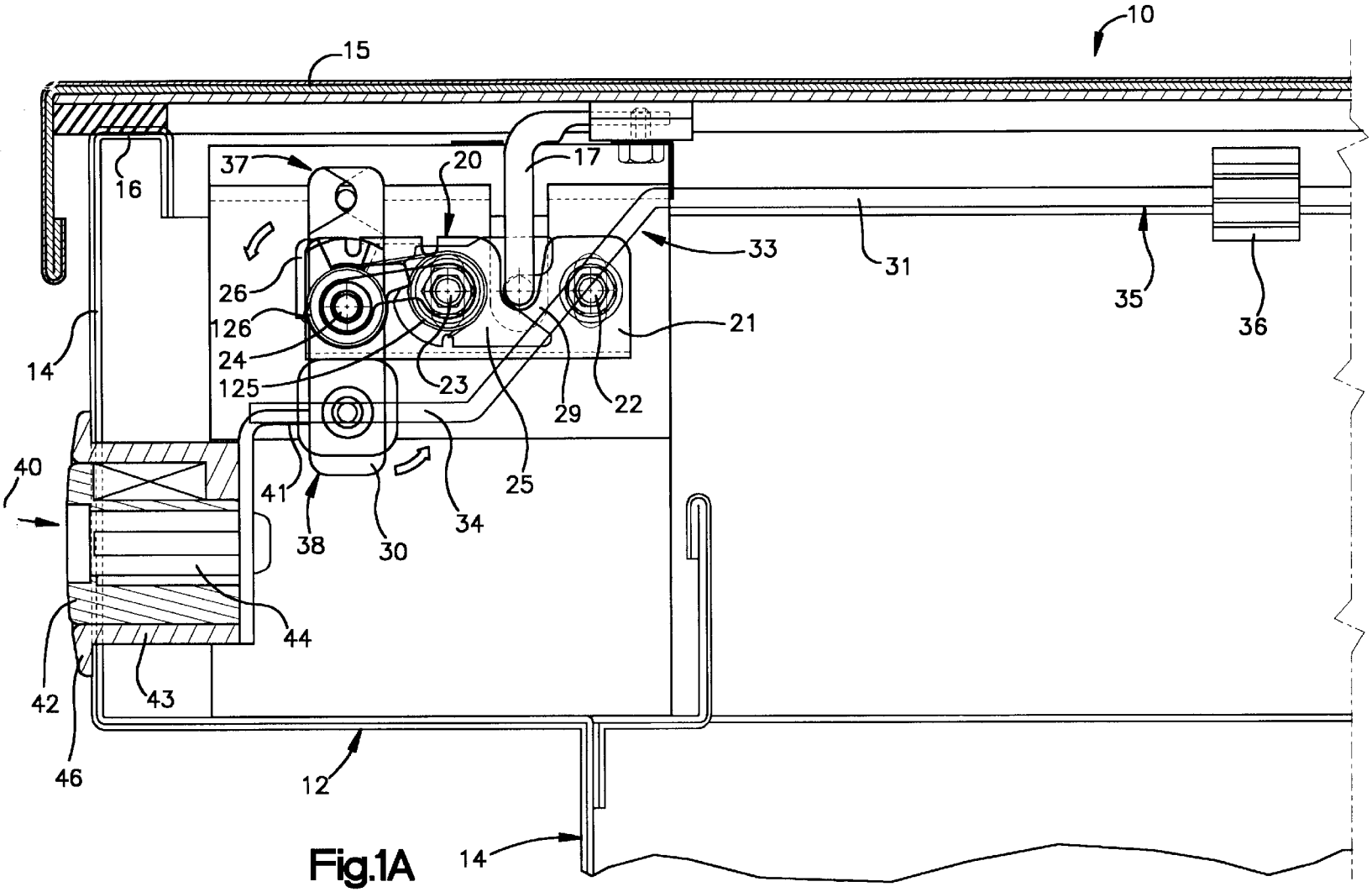
FIG. 1 is an elevational view of a portion of a pickup truck box with a latch and lock system of the present invention.
Figure 1B:
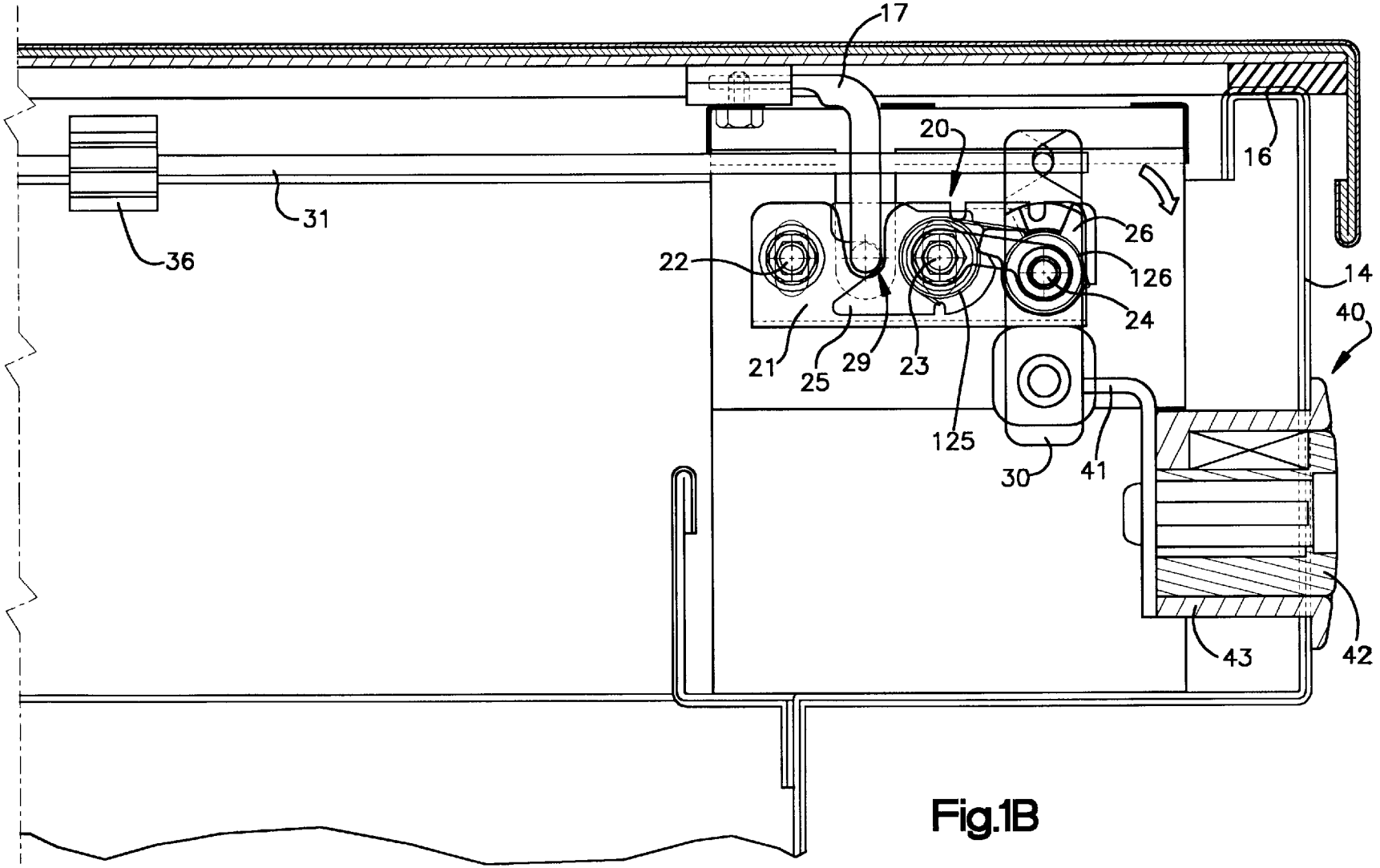
Figure 2:
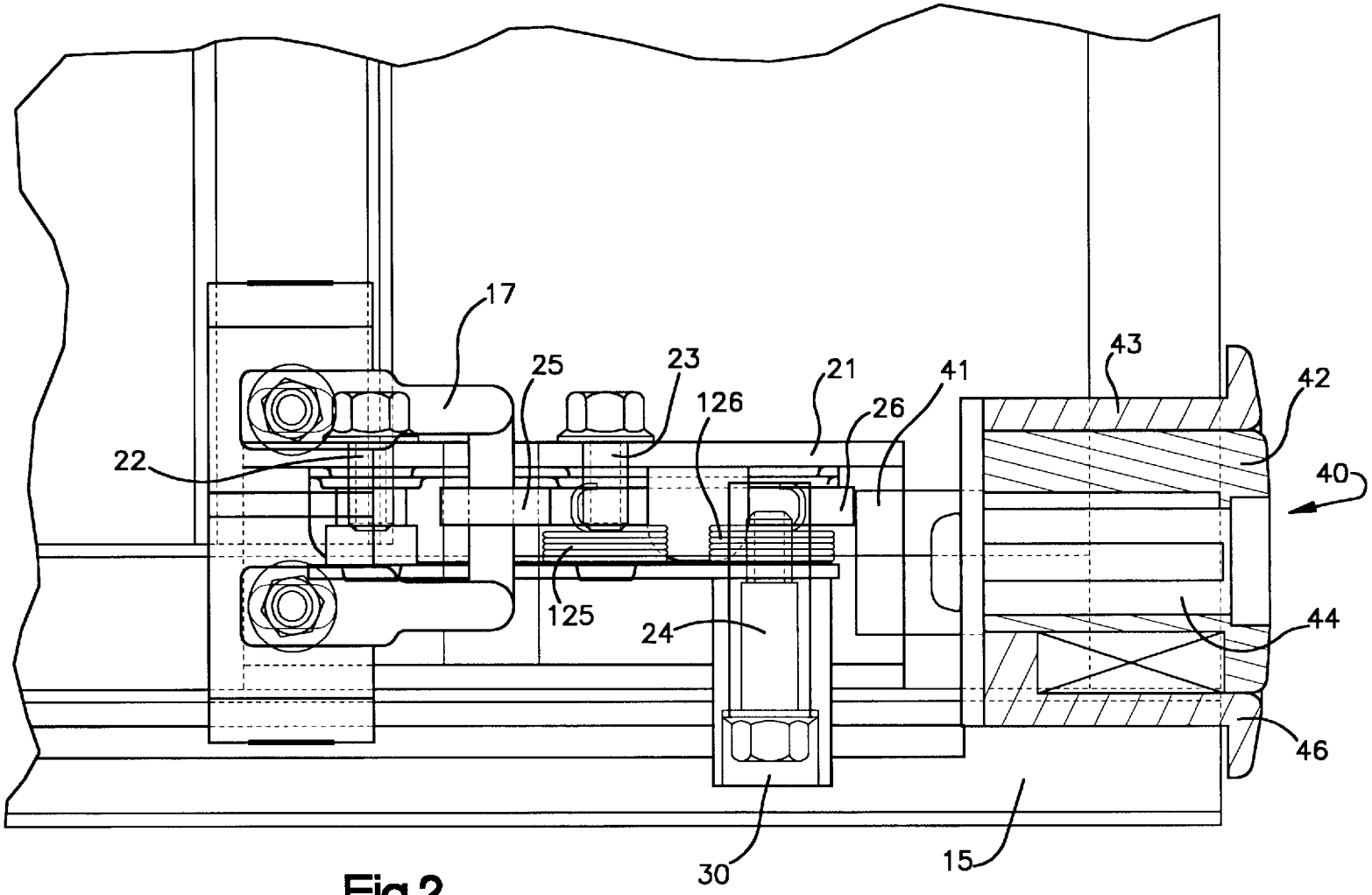
FIG. 2 is a top view of a pickup truck box latch and lock assembly of the present invention.
Figure 3:
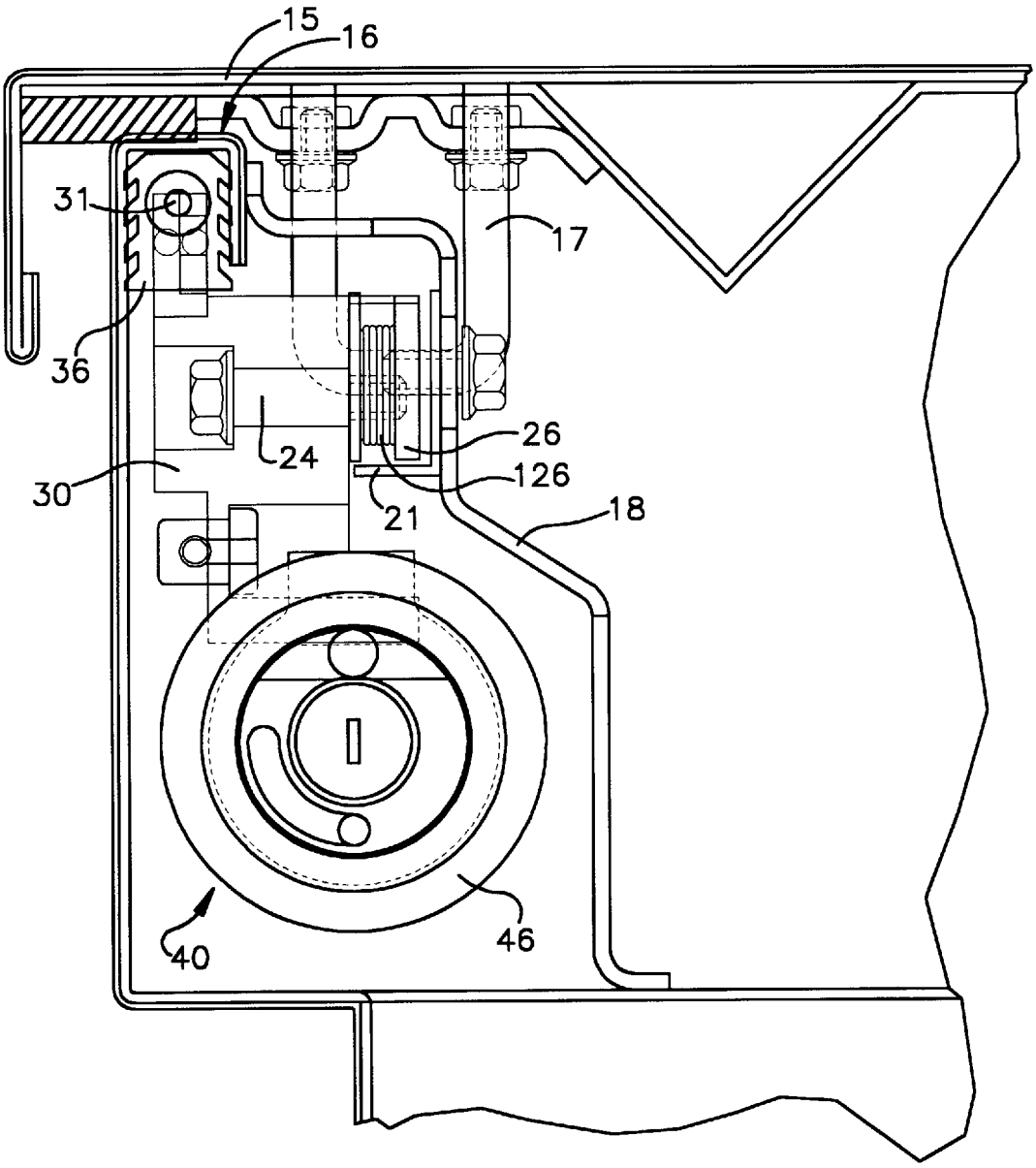
FIG. 3 is a side elevational view of a pickup truck box latch and lock assembly of the present invention.

With reference to FIGS. 1–3, a pickup truck box 10 includes a box body 11 with an upper section 12 which extends over the side walls or rails of a pickup truck bed in which the box is installed, and a lower section 13 (partially shown) which extends into the bed cavity. The upper section 12 includes lateral and longitudinal side walls 14. A box lid 15 covers the vertical opening of box 10 and is hinged at a top edge of longitudinal side wall 14, and shown closed upon a perimetric edge 16 of side walls 14.

To hold box lid 15 securely in the closed position, first and second strikers 17 are attached to the underside of lid 15, by suitable fasteners such as bolts or screws or welds, at the edges or corners of lid 15 near box side walls 14, for engagement with corresponding latch assemblies, indicated generally at 20. The strikers are preferably adjustably fastened by fasteners in slots in the striker base feet. Latch assemblies 20 are mounted inside box upper section 12 by attachment to a mounting bracket 18 (best shown in FIG. 3) which is directly attached to the interior of the box in any suitable manner such as by fasteners or by welds. Latch assemblies 20 are adjustably mounted on the interior side of mounting brackets 18 to avoid interference with the interior of the box.

Figure 4A:
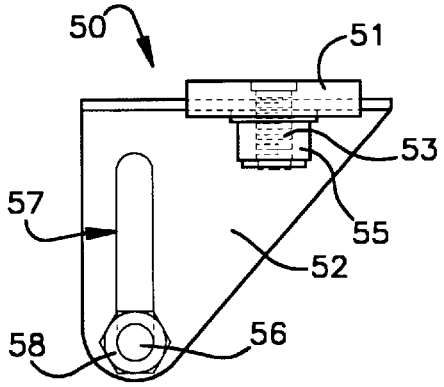
FIGS. 4A–C are side, end and top views, respectively, of the adjustable striker assembly of the present invention.
Figure 4B:
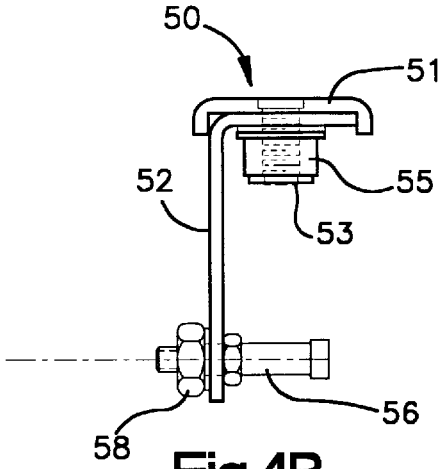
Figure 4C:
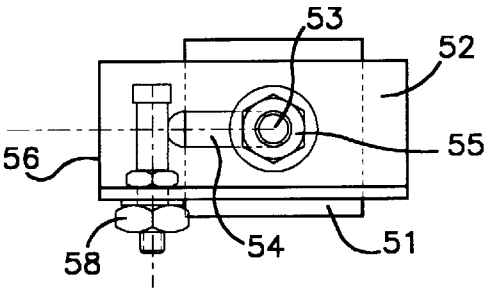

As shown in FIGS. 4A–4C, the strikers 17 can be substituted with an adjustable striker assembly 50 which is welded or bolted to the interior of the box lid in approximately the same location. Each adjustable striker assembly 50 includes a mounting plate 51 welded or otherwise fixed to the interior of the box lid, and a bracket 52 adjustably fastened to the mounting plate by a threaded stud 53 through an adjustment slot 54 and nut 55. A striker pin 56 is held in an adjustment slot 57 in bracket 52 by nut 58, whereby the striker assembly 50 is adjustable along two orthogonal axes which is desirable for installation and adjustment of the system within pickup truck boxes of various dimensions and tolerances.

Each latch assembly 20 includes a latch body 21 in the form of an elongate channel with three transverse pins 22, 23 and 24 to house and mount a latch 25, a trip pawl 26 and corresponding biasing spring 27 and 28. The latch body 21.further includes a transverse striker-receiving valley 29. A cam 30 is connected to trip pawl 26 and pivotally attached to pin 24 to closely flank the latch body 21 as shown in FIGS. 2 and 3. Rotation of cam 30 about pin 24 thus rotates trip pawl 26 in the direction indicated in FIG. 1 to allow latch 25 to rotate in the same direction to an open/striker-receiving position.

Cam 30 is rotated (and trip pawl 26 and latch 25 thereby actuated) by a trip arm 41 mounted for linear translation on the interior end of a plunger or pushbutton type latch opening mechanism, indicated generally at 40. The opening mechanism 40 includes a cylindrical button 42 within a bezel 43 which is mounted through side wall 14 so that an end face of the button is accessible from the exterior of box 10. A sealing gasket may be provided between the bezel and the exterior of box wall 14. Depression of button 42 into bezel 43 translates trip arm 41 in the linear direction indicated to impinge upon cam 30 at a point offset from pivot pin 24, to thereby induce rotation of cam 30 and trip pawl 26 in the direction shown to open latch 25. Trip pawl 26 is spring-biased against rotation in the indicated direction by a torsion spring 126 mounted about pin 24 and radially compressed between the latch body 21 and trip pawl 26. Latch 25 is spring biased to the open position by a torsion spring 125 mounted about pin 23 and radially compressed between the latch body 21 and latch 25. In a preferred embodiment of the invention, the spring rate of spring 126 is greater than the spring rate of spring 125, whereby the latching force required to engage the striker in the latch is less than the tripping force required to open the latch by the opening mechanism 40.

In a locking embodiment of opening mechanism 40, an axially rotatable lock cylinder 44, such as a Cleveland Hardware model J201 or any other similar lock as are commonly known, is axially incorporated into cylindrical button 42 with trip arm 41 secured to an interior end of lock cylinder 44, opposite a lock cylinder key hole 45 at the exposed face of button 42. Rotation of lock cylinder 44 (effected by insertion and rotation of a matching key in keyhole 45, as is well known in the art) thus rotates trip arm 41 to an equal degree where, in a locked position, cam 30 is completely out of the linear path of the trip arm when button 42 is depressed. For example, 90° clockwise rotation of the lock and trip arm. The locked and unlocked positions of lock cylinder 44 can be indicated on the external face of bezel 43.

Because opening mechanism 40 is not permanently mechanically engaged with the latch assembly, i.e., there is no fixed mechanical connection or linkage between trip arm 41 and cam 30, forceful attack upon the opening mechanism (such as for example by heavy impact driving of a massive member along the axis of button 42) cannot effect release of latch 25 via the cam-actuated trip pawl 26 when the lock cylinder is in the locked position. In other words, the lock system of the invention is highly vandal resistant.

To couple the laterally opposed latch assemblies 20 to enable release of both latches 25 by operation of either opening mechanism 40, a connecting cross rod 31 extends from one cam 30 to the other, to asymmetrically couple the latches so that actuation of one actuates the other. As shown in the latch assembly on the left side of FIG. 1, connecting rod 31 at this end includes a generally downwardly bent segment 33 and a lower horizontal segment 34 attached to a lower section 37 of cam 30 at a point below pivot pin 24, and approximately at the same elevation at which trip arm 41 impinges upon the cam. Rotation of cam 30 in the direction indicated induces lateral horizontal translation of a main horizontal segment 35 of connecting rod 31 which, at the opposite end shown on the left side of FIG. 2, is connected to a top end 38 of cam 30, above pivot pin 24, so that the horizontal lateral displacement of connecting rod 31 induces or follows rotation of cam 30 in the direction indicated, consistent with the rotation induced by the corresponding trip arm 41. By this arrangement both latches 25 can be released by either opening mechanism 40. And, as described above, if either opening mechanism is in a locked position, it is completely inoperative, having no fixed or permanent connection to the corresponding latch assembly.

As best shown in FIG. 3, the main horizontal segment 35 of connecting rod 31 is positioned underneath the hemmed edge 16 of the pickup truck box and held there by a connecting rod guide 36 which is friction fit under edge 16 to hold the rod in alignment with the opposed latch assemblies and out of the way of the interior of the box.

Figure 5:
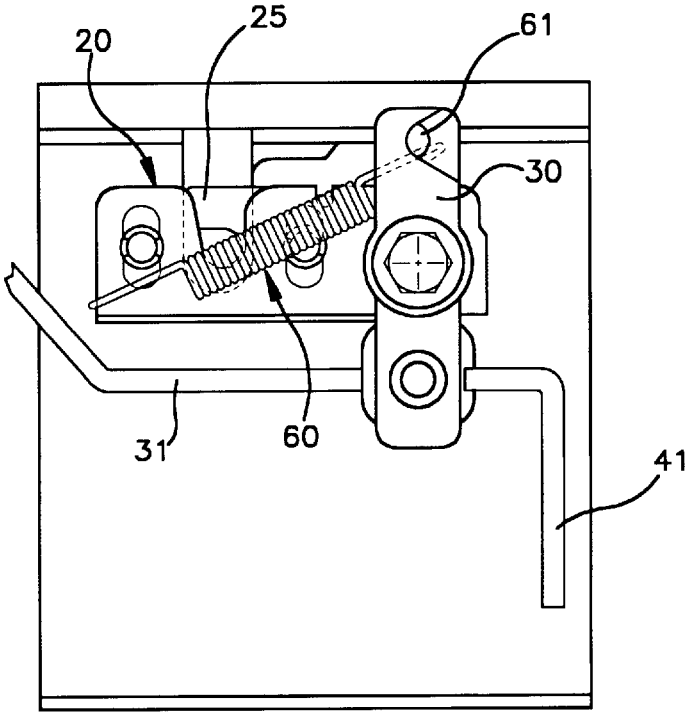
FIG. 5 is an elevational view of the latch assembly of the present invention.

As shown in FIG. 5, a latch return spring 60 can be provided on the passenger side latch assembly of the system to bias the cam 30 to the upright position shown. The latch return spring 60 is attached at one end to an inboard edge of the latch body 21 and at an opposite end to rod hole 61 of cam 30. The latch return spring 60 biases the cam 30 against the cylindrical button 42, to insure that the latch assembly is in an openable configuration following closure of the lid.

The described invention thus provides a novel system for securely latching and locking a lid of a box. Although described in connection with pickup truck boxes as merely a non-limiting example, it is to be appreciated that the basic concepts and components of the latch and lock system of the invention can be applied to any other type of closing lid or door arrangement wherein internal latching and locking is desired. Nonetheless, the invention is particularly well-suited for application to a single lid/dual latch arrangement such as a pickup truck box wherein the lid can be latched with the two latch assemblies in either the locked or unlocked positions; can be opened by operation of only one of the latch assemblies in the unlocked position (even if the other latch assembly is in the locked position); and cannot be forcibly opened by punching out either lock cylinder due to the fact that the opening mechanism trip arms are not in fixed mechanical connection with the corresponding latch assemblies.

The invention is thus defined by the following claims which include all equivalent structures and all equivalent systems which perform substantially the same function in substantially the same way to achieve substantially the same result, and/or have only insubstantial differences from the invention.

What is claimed is:

1. A latch and lock system for a pickup truck box having a single lid hinged to open along a length of the box comprises:

first and second latch strikers adapted to be attached to an underside of said box lid, first and second latch assemblies each attached to a corresponding mounting bracket for mounting inside the box, each latch assembly including a latch mounted on a first transverse pin within a latch body and positioned for engagement with a corresponding striker when the box lid is closed, each latch assembly further including a trip pawl mounted in the latch body on a second transverse pin within the latch body and in operative contact with the latch, and a discrete cam mounted adjacent to the trip pawl on the second transverse pin to rotate with the trip pawl, a cross rod connected at opposite ends to the cams of the first and second latch assemblies, and first and second latch opening mechanisms for mounting in side walls of the box, each latch opening mechanism having a trip arm able to be put in operative contact with a corresponding cam upon actuation of the opening mechanism.

2. The latch and lock system of claim 1 wherein each latch body has a striker-receiving valley.

3. The latch and lock system of claim 1 wherein each latch assembly further comprises a torsional spring about the latch and a torsional spring about the trip pawl, wherein a spring rate of the torsional spring about the latch is less than a spring rate of the torsional spring about the trip pawl.

4. The latch and lock system of claim 1 wherein each opening mechanism comprises a pushbutton for mounting in a side wall of said pickup truck box, the pushbutton connected to the trip arm.

5. The latch and lock system of claim 4 wherein each opening mechanism further comprises a rotatable lock cylinder incorporated in the pushbutton whereby the trip arm is rotatable with the lock cylinder.

6. The latch and lock system of claim 1 further comprising at least one connecting rod guide for positioning in the interior of said pickup truck box and intersected by the cross rod.

7. The latch and lock system of claim 1 wherein the first and second latch strikers are adjustable striker assemblies; each said adjustable striker assembly having at least one adjustment slot.

8. A latch assembly for receiving and holding a striker in a latched position, the latch assembly comprising a latch body having opposed walls, a striker-receiving valley, a latch and trip pawl each pivotally mounted through the opposed walls about pins which traverse the latch body, a torsion spring about each pin, one torsion spring compressed between the latch and the latch body and another torsion spring compressed between the trip pawl and the latch body, and a discrete cam pivotally mounted adjacent the trip pawl upon the pin on which the trip pawl is pivotally mounted, the cam being pivotable by and not connected to an opening mechanism whereby pivoting of the cam causes pivoting of the trip pawl which allows the latch to pivot to an open position.

9. A latch system comprising the latch assembly of claim 8 and an opening mechanism comprising a linearly translatable trip arm operable to be placed in temporary contact with the cam of the latch assembly to induce rotation of the cam to open the latch.

10. A latch and lock system comprising the latch assembly of claim 8 and an opening mechanism comprising a linearly translatable trip arm connected to a rotatable lock cylinder, the lock cylinder and trip arm being movable along a linear path into contact with the cam of the latch assembly to induce rotation of the cam to open the latch, the trip arm being rotatable by rotation of the lock cylinder to a radial position wherein linear translation of the lock cylinder and trip arm does not contact the cam of the latch assembly.

11. The latch assembly of claim 8 including a mounting plate and wherein the latch body is secured to an interior side of said mounting plate for attachment to an interior of a container.

12. A latch and lock system comprising a latch assembly for receiving and holding a striker, the latch assembly including a latch body having a striker-receiving valley, and a latch and a trip pawl pivotally mounted on pins within the latch body, torsion springs about the pins on which the latch and trip pawl are mounted, one torsion spring compressed between the latch and the latch body, and another torsion spring compressed between the trip pawl and the latch body, a discreet cam attached to the pin on which the trip pawl is mounted and adjacent the trip pawl, and an opening mechanism for pivoting the cam to pivot the trip pawl to allow the latch to pivot to an open position wherein a striker is free to exit the striker-receiving valley.

* * * * *